United States Patent [19]

Ueno

[11] Patent Number: 4,936,802

[45] Date of Patent: Jun. 26, 1990

[54] SWINGING AND PROPELLING SHIP

[75] Inventor: Yasuo Ueno, Kawasaki, Japan

[73] Assignee: Sunaga Kaihatsu Kabushiki Kaisha, Japan; a part interest

[21] Appl. No.: 305,131

[22] Filed: Feb. 2, 1989

[51] Int. Cl.[5] ..... B63H 16/08

[52] U.S. Cl. ..... 440/13; 440/21

[58] Field of Search ..... 440/13–15, 440/21, 22; 416/79, 81; 114/143

[56] References Cited

U.S. PATENT DOCUMENTS

| | | | |
|---|---|---|---|
| 2,241,305 | 5/1941 | Hill, Jr. | 440/15 |
| 2,367,765 | 1/1945 | Fickler | 115/4 |
| 3,110,283 | 11/1963 | Warner | 440/15 |
| 3,640,240 | 2/1972 | Stein | 440/15 |
| 3,972,300 | 8/1976 | Adamski | 114/143 X |
| 4,371,347 | 2/1983 | Jakobsen | 440/9 |

FOREIGN PATENT DOCUMENTS

| | | | |
|---|---|---|---|
| 3431660 | 3/1986 | Fed. Rep. of Germany | 440/22 |

*Primary Examiner*—Sherman D. Basinger
*Attorney, Agent, or Firm*—Lorusso & Loud

[57] ABSTRACT

The present invention relates to a propulsion device for a boat. A manually powered ship wherein a wing-like fin whose front edge is round and rear edge is sharp is mounted on a shaft provided in a direction parallel to the longitudinal axis of a ship so that the fin is positioned in water below a hull, and the shaft is rotated reciprocally by human power to thereby swing the fin to obtain a propelling force.

6 Claims, 2 Drawing Sheets

SWINGING AND PROPELLING SHIP

BACKGROUND OF THE INVENTION

1. Field of the Invention

The present invention relates to an improvement in a propelling device of a ship or boat principally used for sports and leisures, and more particularly to a small ship which is simple in construction and which can efficiently run by human power.

2. Description of the Prior Art

Conventional ships which can be run by human power heretofore developed include those in which an oar is pulled by hand and in which a pedal is stepped by foot to rotate a water wheel, and the like.

However, the ship in which an oar is pulled by hand has good propulsive efficiency but both hands are occupied pulling the oar, and therefore, other operations cannot be performed. In addition, the ship of the type in which a pedal is stepped by foot to rotate a water wheel has a problem in that the construction thereof is complicated and yet the propulsive efficiency is poor and the operator becomes easily tired.

SUMMARY OF THE INVENTION

It is therefore an object of the present invention to provide, in order to solve the above-described problem, a manually powered ship characterized in that a wing-like fin whose front edge is round and rear edge is sharp is mounted on a shaft provided in a direction parallel to the longitudinal axis of a ship's hull so that the fin is positioned in water below the hull, and the shaft is rotated reciprocally by human power to thereby swing the fin back and forth to obtain a propelling force.

In the manually powered ship according to the present invention, the fin mounted on the hull is swung to left and right by the shaft 3 mounted parallel with the longitudinal axis of the hull so that the ship runs. The construction of the ship is very simple and the ship can be moved with high efficiency by stepping the pedal by foot. In addition, at least one hand is free and less physical strength is consumed. The ship can be run for a long distance at high speeds, and therefore, the ship has a wide range of applications in addition to sports, and the effect thereof is extremely remarkable.

DETAILED DESCRIPTION OF THE PREFERRED EMBODIMENTS

Figure 1:
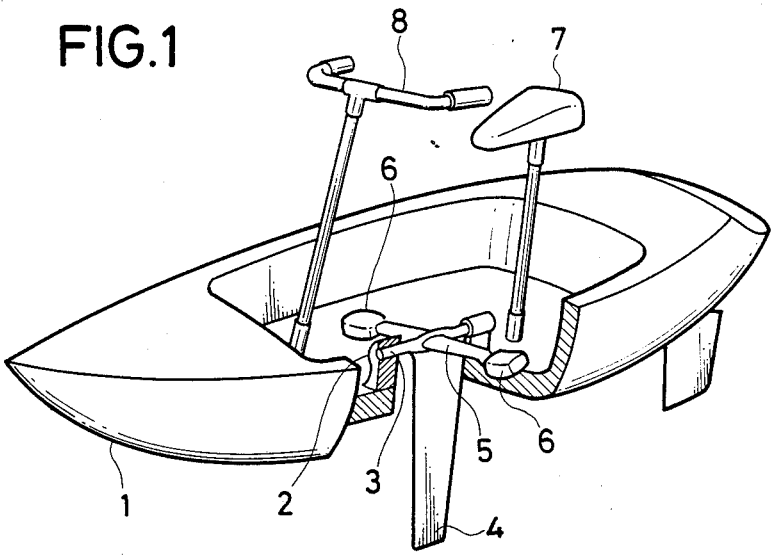
FIG. 1 is a partially cutaway perspective view showing a preferred embodiment of the present invention.

Referring now to FIG. 1, a bearing 2 is provided on the bottom of a hull 1, and a shaft 3 is mounted, parallel to the longitudinal axis of the hull, in the central portion of the ship's bottom so that the shaft 3 may be rotated to left and right.

The shaft 3 has a wing-like fin 4 downwardly secured thereto and levers 5 laterally secured thereto, and a pedal 6 is mounted at the end of the lever 5.

Figure 2:
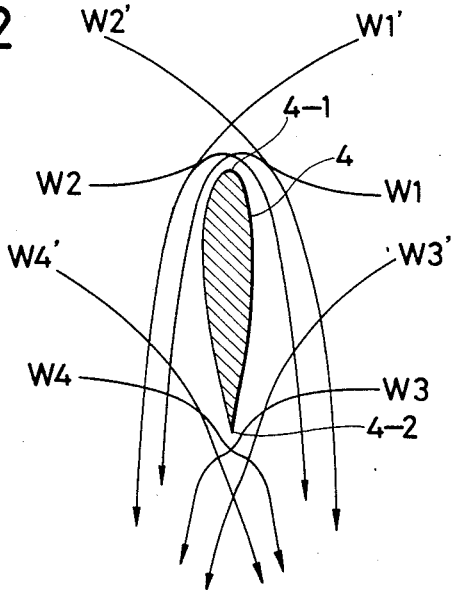
FIG. 2 is a view for explaining the propelling principle of the fin.

The fin 4 has a front edge 4-1 which has a roundness, and a rear edge 4-2 which is sharp, as shown in section of FIG. 2, which is like a section of a wing of an aircraft. This is however, a symmetrical wing without a so-called bow-like camber.

Figure 4:
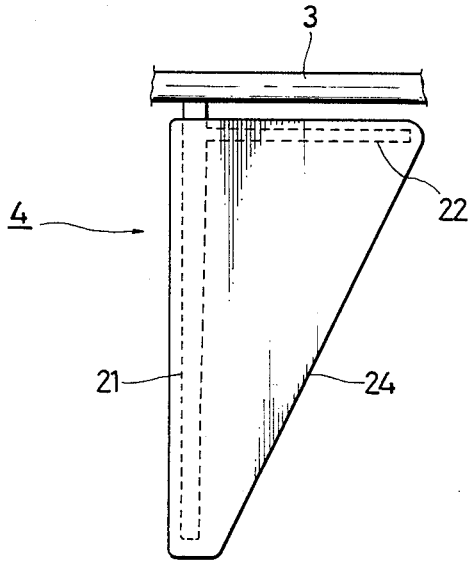
FIG. 4 is a side elevation of one embodiment of the fin of the watercraft of FIG. 1.

Alternatively, the fin 4 may be of the type in which, as shown in FIG. 4, a rib rod of high rigidity is formed into an inverted L shape and a front edge rod portion 21 is hung from the shaft 3 and a wing chord rod portion 22 is embedded into a fin body 24 having a predetermined softness and elasticity such as rubber, plastic or the like.

In the Figure, reference numeral 7 represents a saddle; and 8, a handle. It is preferably designed so that the handle 8 is connected to a rudder 9 by means of a mechanism not shown, and the handle 8 is moved to left and right whereby the rudder 9 is likewise moved to left and right.

Figure 3:
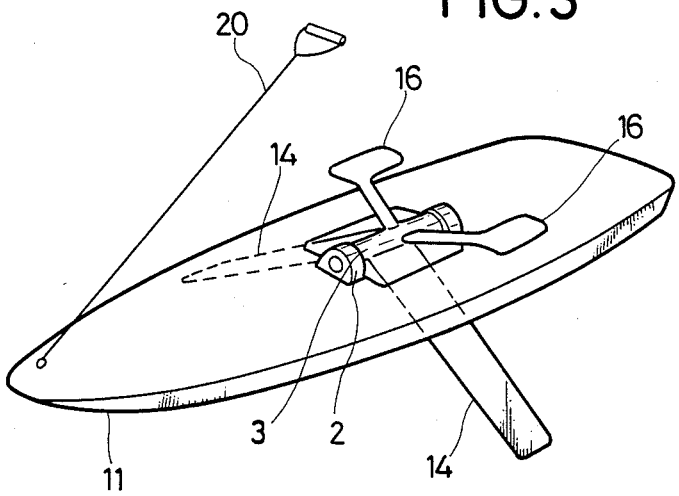
FIG. 3 is a perspective view showing a further embodiment of the present invention.

Next, referring to FIG. 3, is shown a further embodiment according to the present invention. A hull 11 has a similar boat-like configuration in which two inverted L shaped fins 14 extend obliquely and downwardly of the hull, a pedal 16 is in the form of a laterally extending pedal, and a string 20 is attached to the bow.

In FIG. 2, the upward direction in the figure is the direction of movement. When an operator sits on the saddle 7 and steps the pedal 6 alternately to swing the fin 4 to left and right, flow W1 along the right side of the fin 4 and flow W2 along the left side thereof bend rearwardly from the front edge 4-1 of the fin 4.

In the rear edge 4-2, since the portion thereof is sharp, it cannot be turned and is pressed and bent rearwardly by the rearwardly-directed flows W1 and W2 from the front edge as in W3 and W4.

Since the flows W1, W2, W3 and W4 are rearwardly directed, forward thrust as a reaction thereto is obtained.

When the hull 1 begins moving forward, the flows W1′ and W2′ of water become smooth since they come obliquely from the front due to the relative speed, and W3′ and W4′ show the rearward flows.

Next, in the embodiment shown in FIG. 3, the left and right feet are placed on the pedal 16 and the operator stands up and holds the string 20 to keep his balance.

The inverted L shaped fins 14 are formed so that they cross each other at an angle approximating a right angle, which provides the effect of preventing rolling of the entire hull.

The fins are moved to a position at which one fin 14 is shallow and the other fin 14 is deep whereby the thrust acting on the fin 14 at the shallow position is laterally deviated from the center of gravity of the hull in order to provide a turning force. Therefore, the ship can be turned to left and right depending on the movement of the fin 14. Accordingly, the rudder 9 provided in the first embodiment is not required.

Accordingly, the ship according to the embodiment shown in FIG. 3 is suitable for use with sports which require free running on the water.

In the caseof the fin 4 shown in FIG. 4, a fin body 24 is twisted due to the force of water resulting from swinging, and the flow of water bends smoothly rearward and the hull 1 can move forward due to the reaction thereof. Accordingly, particularly at the start, a large thrust can be obtained.

Furthermore, when the speed increases, the torsional angle is automatically reduced along the direction of water flow due to the expansibility of the fin body 24, and therefore, the propulsive efficiency is not lowered even at high speed.

What is claimed is:

1. A manually powered watercraft comprising:

a hull having a bow, a stern and an opening therethrough;

a shaft;

means for rotatably mounting said shaft on said hull, parallel to the longitudinal axis of said hull;

rotating means for manually rotating said shaft reciprocally about its longitudinal axis;

at least one fin secured to said shaft and extending through said opening in said hull, said fin having a rounded leading edge and a substantially sharper trailing edge, said leading edge facing the bow of said hull and said trailing edge facing the stern of said hull;

whereby reciprocal movement of said shaft moves said fin reciprocally, back and forth through water, beneath said hull, thereby propelling said watercraft in the direction to which said bow is pointed.

2. The watercraft of claim 1 wherein said fin is shaped as a bilaterally symmetrical wing in cross-section.

3. The watercraft of claim 1 wherein said fin is composed of an elastomeric material with an inverted L-shaped rigid rod embedded therein, said rod having one leg embedded near the leading edge of said wing and the other leg embedded in the side of the fin nearest said shaft, said leg of said shaft near said leading edge being secured to said shaft.

4. The watercraft of claim 1 wherein said trailing edge of said fin is substantially more elastic than said leading edge.

5. The watercraft of claim 1 wherein a second fin is secured to said shaft, said one fin and said second fin being angularly displaced and adjoining each other at an angle on said shaft along coextensive upper edges.

6. The watercraft of claim 1 wherein said fin is attached to said shaft along the entire length of its upper edge.

* * * * *